US008303087B2

(12) United States Patent
Linliu

(10) Patent No.: US 8,303,087 B2
(45) Date of Patent: Nov. 6, 2012

(54) PACKAGE STRUCTURE OF INKJET-PRINTHEAD CHIP

(75) Inventor: Kung Linliu, Hsinchu (TW)

(73) Assignee: National Synchrotron Radiation Research Center, Hsinchu (TW)

( * ) Notice: Subject to any disclaimer, the term of this patent is extended or adjusted under 35 U.S.C. 154(b) by 55 days.

(21) Appl. No.: 13/050,206

(22) Filed: Mar. 17, 2011

(65) Prior Publication Data

US 2011/0164090 A1 Jul. 7, 2011

Related U.S. Application Data

(62) Division of application No. 11/600,018, filed on Nov. 16, 2006, now Pat. No. 7,954,924.

(51) Int. Cl.
*B41J 2/14* (2006.01)

(52) U.S. Cl. ..... 347/47

(58) Field of Classification Search ..... 347/40, 347/43, 47, 64–65
See application file for complete search history.

(56) References Cited

U.S. PATENT DOCUMENTS 7,475,964 B2 * 1/2009 Benson et al. ..... 347/50
7,744,194 B2 * 6/2010 Yokouchi ..... 347/50

* cited by examiner

*Primary Examiner* — Lamson Nguyen
(74) *Attorney, Agent, or Firm* — Rosenberg, Klein & Lee

(57) ABSTRACT

The present invention discloses a package structure of an inkjet-printhead chip. The structure includes: a nozzle structure of a print element including an ink chamber layer, a nozzle base layer on the ink chamber layer, and a nozzle layer on the nozzle base layer, wherein a plurality of nozzle through holes are set in the nozzle layer and pass through an ink chamber of the ink chamber layer; a flexible substrate set on the nozzle layer, wherein there is at least an opening set in the flexible substrate to expose those nozzle through holes; and a chip set under the ink chamber layer. Besides, the present package method is to utilize the micro-manufacturing process to form the nozzle structure of a print element and the tape automatic bonding process to bond the flexible substrate on the nozzle layer and the chip under the ink chamber layer.

5 Claims, 5 Drawing Sheets

PACKAGE STRUCTURE OF INKJET-PRINTHEAD CHIP

RELATED APPLICATIONS

This application is a Divisional patent application of Ser. No. 11/600,018, filed on 16 Nov. 2006, currently pending.

BACKGROUND OF THE INVENTION

1. Field of the Invention

The present invention relates to a package structure of a chip, and more especially, to package structure of an inkjet-printhead chip.

2. Background of the Related Art

The inkjet-printhead is the key component of the inkjet printer. The reliability, the density of the spurted holes and the small size are increasingly demanded for the package structure of the inkjet-printhead chip due to the demands of high printing quality and high resolution. Therefore, the demands of the package and bonding technique for the inkjet-printhead chip are getting stricter.

FIG. 1 is a cross-sectional schematic diagram illustrating the inkjet-printhead structure of the U.S. Pat. No. 5,420,627, and it discloses the ink cartridge with edge feed design, which is widely utilized in the wide format, commercial and desktop printer. The advantage of the inkjet-printhead 100 is to cool the heating chip 128 better due to the ink flow, which provides several rows of the ink-drop producing chambers along two long edges. The heating chip 128 is adhered on a flexible substrate component 118 and corresponded to the spurted holes cut by an arched laser. The flexible substrate component 118 with elasticity also has the golden fingers for tape automatic bonding to electrically connect with the solder pads on a short edge of the heating chip 128. However, it is necessary to use an excimer laser to drill the spurted holes of the flexible substrate component 118 and to aim the laser at the chip accurately, but the excimer laser is expensive for manufacturing.

SUMMARY OF THE INVENTION

In order to solve the foregoing problems, one object of this invention is to provide a package structure of an inkjet-printhead chip, which can effectively lower the accuracy required by the package and reduce the manufacturing cost of the ink-flow holes.

One object of this invention is to provide a package structure of an inkjet-printhead chip, which can increase the ink storage space and lower the manufacturing cost.

One object of this invention is to provide a package structure of an inkjet-printhead chip without using the expensive excimer laser to effectively lower the cost.

An embodiment of the present invention provides a package structure of the inkjet-printhead chip, which includes: a nozzle structure of a print element including an ink chamber layer; a nozzle base layer set on the ink chamber layer; and a nozzle layer set on the nozzle base layer, wherein a plurality of nozzle through holes are set in the nozzle layer and pass through an ink chamber of the ink chamber layer; a flexible substrate set on the nozzle layer, wherein there is at least an opening set in the flexible substrate to expose the nozzle through holes; and a chip set under the ink chamber layer.

DETAILED DESCRIPTION OF THE INVENTION

Figure 1:
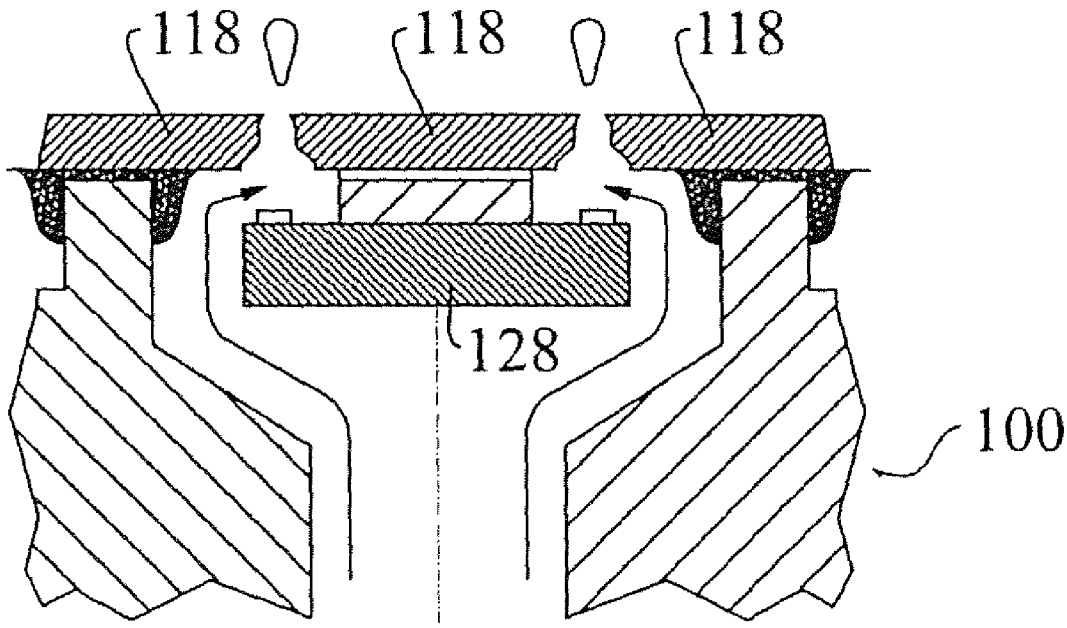
FIG.1(Prior Art)
FIG. 1 is a cross-sectional schematic diagram illustrating the inkjet-printhead structure of the U.S. Pat. No. 5,420,627.

FIG. 2A to FIG. 2E are the schematic cross-sectional diagrams illustrating the procedures of the package method of the inkjet-printhead chip in accordance with one embodiment of the present invention. At first, please refer to FIG. 2D, which is a package structure of the inkjet-printhead chip of the present invention. As shown in the FIG. 2D, the package structure of the inkjet-printhead chip includes a nozzle structure of a print element, and the nozzle structure includes an ink chamber layer 10, a nozzle base layer 20 and a nozzle layer 30, wherein the nozzle base layer 20 is optional and depends on the case. A plurality of nozzle through holes 32 pass through the nozzle base layer 20 and the nozzle layer 30 to connect with an ink chamber 12 of the ink chamber layer 10. A flexible substrate 40 with at least an opening 42 is set on the nozzle layer 30, and the opening 42 corresponds to and exposes the nozzle through holes 32. A chip 50 is set under the ink chamber layer 10.

Continuously, please refer to FIG. 2A to FIG. 2E, which illustrate the package method of the inkjet-printhead chip by utilizing the micro-manufacturing process and the tape automatic bonding process. At first, as shown in the FIG. 2A, an ink chamber layer 10 is formed by the chemical deposition or the physical deposition, and an ink chamber 12 is formed on the ink chamber layer 10 by the lithography process. Next, as shown in the FIG. 2B, a nozzle base layer 20 is formed on the ink chamber layer 10 and a nozzle layer 30 is formed on the nozzle base layer 20 by the deposition way. Then, referring to FIG. 2C, the nozzle layer 30 and the nozzle base layer 20 are etched by dry etching to form a plurality of nozzle through holes 32 through the ink chamber 12 of the ink chamber layer 10 to complete the nozzle structure of the print element.

Figure 2A:
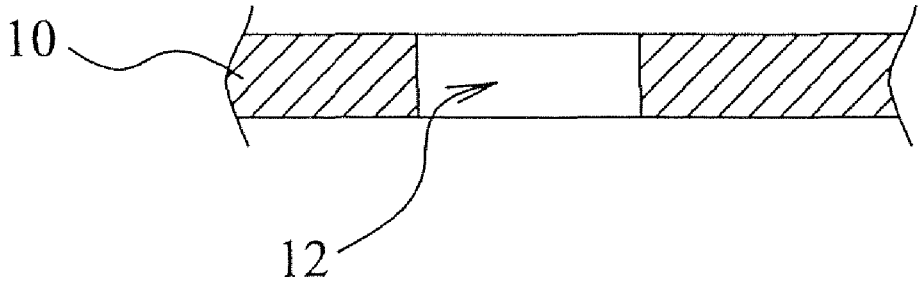
FIG. 2A, FIG. 2B, FIG. 2C, FIG. 2D and FIG. 2E are the cross-sectional schematic diagrams illustrating the procedures of the package method of the inkjet-printhead chip in accordance with an embodiment of the present invention.
Figure 2B:
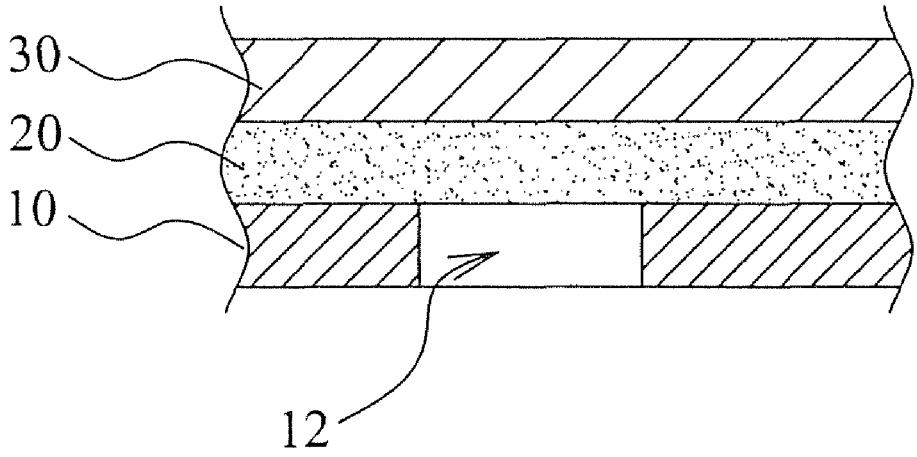
Figure 2C:
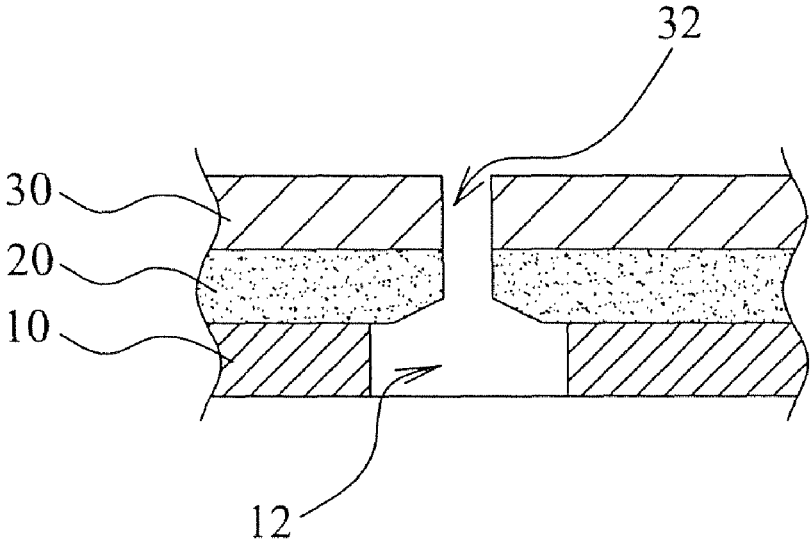
Figure 2D:
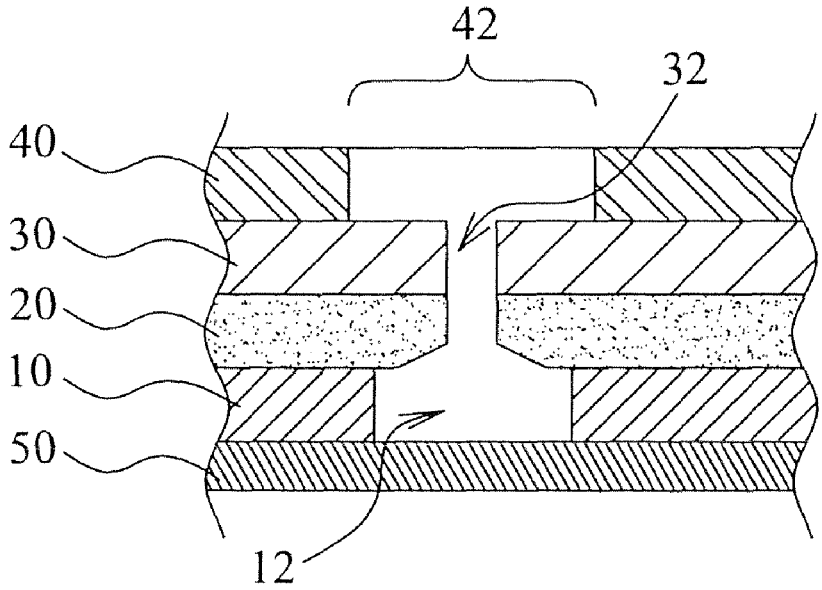

Please refer to FIG. 2D continuously, a flexible substrate 40 is arranged on the nozzle layer 30 by utilizing the tape automatic bonding process, and an opening 42 of the flexible substrate 40 corresponds to and exposes the nozzle through holes 32. Next, a chip 50 is arranged under the ink chamber layer 10 and electrically connects with the flexible substrate 40. Further, an adhesion layer (no shown) on the nozzle layer 30 is formed by dispensing to adhere the flexible substrate 40. Finally, a heating process is utilized to cure the adhesion layer to complete the bonding.

Figure 2E:
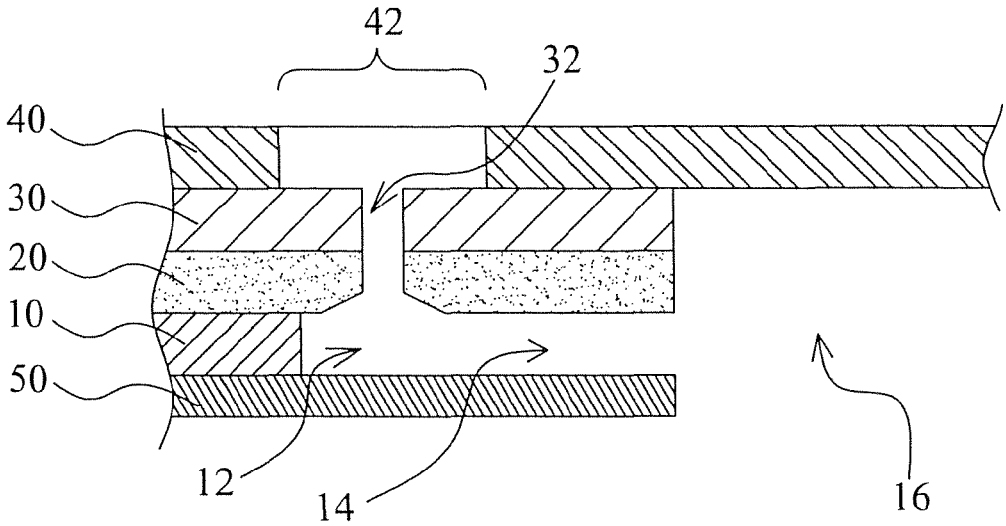

Please refer to FIG. 2E, which is the package structure of the inkjet-printhead chip of the present invention. An ink passage 14 is formed when the ink chamber 12 is formed on the ink chamber layer 10. The ink passage 14 connects the ink chamber 12 with the ink supplying area 16 of the print element to be the edge feed of the inkjet-printhead. Further, the bottom edge of the nozzle through holes 32 near the ink chamber 12 may be etched roundly to make the ink flow more freely.

Figure 3A:
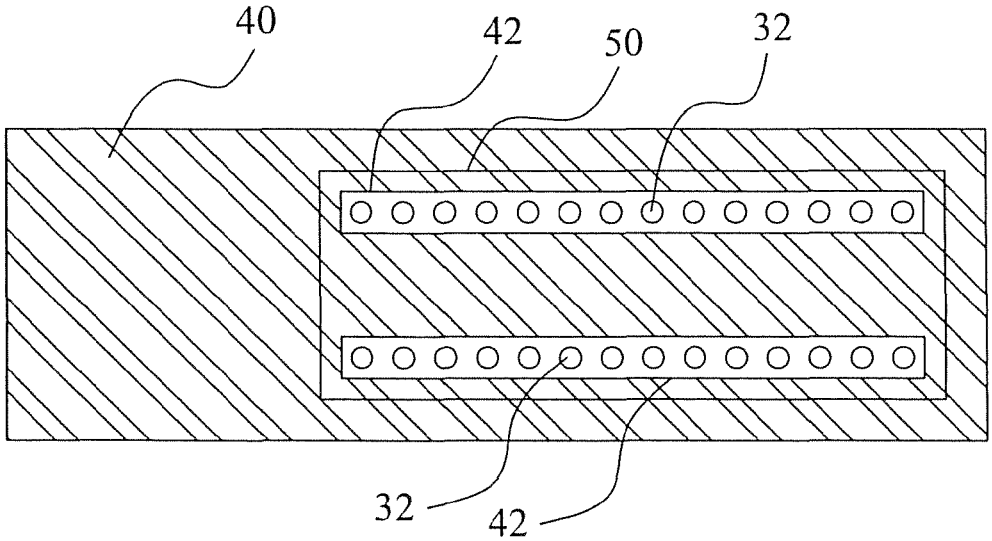
FIG. 3A and FIG. 3B are the front-view schematic diagram and the cross-sectional schematic diagram of the package structure of the inkjet-printhead chip in accordance with an embodiment of the present invention.
Figure 3B:
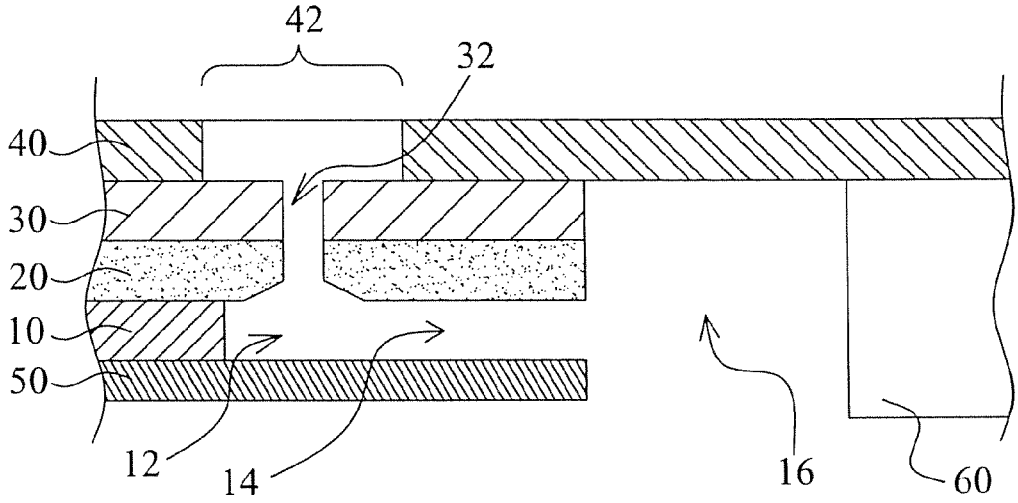

FIG. 3A and FIG. 3B are the front-view schematic diagram and the cross-sectional schematic diagram of the package structure of the inkjet-printhead chip in accordance with one embodiment of the present invention. As shown in the FIG. 3A, at first, the amount and the shape of the opening 42 of the flexible substrate 40 are not limited, and it is only required to bond to the flexible substrate 40 to align and expose the nozzle through holes 32. Besides, the shape, the amount and the arrangement of the nozzle through holes 32 are not limited and depend on the different printing effects of different printers.

Continuously, as shown in the FIG. 3B, in the package structure of the inkjet-printhead chip of the present invention, the nozzle through holes 32 are formed by the micro-manufacturing process, such as the manufacturing process of the semiconductor, and the alignment accuracy of package of the flexible substrate 40 above the nozzle through holes 32 can be lowered to 30 μm to 100 μm without demanding the required accuracy of less than 0.5 μm in the excimer laser for the conventional package. To compare with the conventional package, the nozzle base layer 20 and the nozzle layer 30 are added between the flexible substrate 40 and the chip 50, therefore, an ink storage space is increased for about 50 μm in length among the flexible substrate 40, the chip 50, the nozzle base layer 20 and the nozzle layer 30, and the storage space may effectively buffer the ink pressure of the edge feed to make the ink flow out of the inkjet-printhead more uniformly.

The characteristic of the present invention is to utilize the micro-manufacturing process to form a nozzle structure of a print element, and it can not only reduce the material cost but also have the advantage of easy manufacturing to achieve the efficiency of lower price. Besides, utilizing the tape automatic bonding process to bond the flexible substrate can effectively overcome the defects of the conventional package, which needs high accuracy and expense. To sum up, the present invention can effectively lower the accuracy required for package and reduce the manufacturing cost of the ink-flow holes, and the structure thereof can increase the ink storage space without using the expensive excimer laser, and so as to effectively lower the cost of manufacturing.

Although the present invention has been explained in relation to its preferred embodiment, it is to be understood that other modifications and variation can be made without departing the spirit and scope of the invention as hereafter claimed.

What is claimed is:

1. A package structure of an inkjet-printhead chip, comprising:

a nozzle structure of a print element comprising:

an ink chamber layer;

a nozzle base layer set on said ink chamber layer; and a nozzle layer set on said nozzle base layer, wherein a plurality of nozzle through holes are set in said nozzle layer and pass through an ink chamber of said ink chamber layer;

a flexible substrate set on said nozzle layer, wherein said flexible substrate has at least an opening to expose said nozzle through holes; and a chip set under said ink chamber layer.

2. The package structure of the inkjet-printhead chip according to claim 1, wherein said nozzle through holes pass through said nozzle base layer and said nozzle layer.

3. The package structure of the inkjet-printhead chip according to claim 1, wherein there is an ink passage between said chip and said nozzle base layer to connect said ink chamber and an ink supplying area of said print element.

4. The package structure of the inkjet-printhead chip according to claim 1, further comprising an adhesion layer set between said flexible substrate and said nozzle layer.

5. The package structure of the inkjet-printhead chip according to claim 4, wherein said adhesion layer is formed on said nozzle layer by dispensing.

* * * * *